US006067794A

United States Patent [19]

Simon et al.

[11] Patent Number: 6,067,794

[45] Date of Patent: May 30, 2000

[54] DUAL CONTROL LOOP SYSTEM AND METHOD FOR INTERNAL COMBUSTION ENGINES

[75] Inventors: Edouard Simon, Motte-Picquet; Bernard Givois, Vert-Sait-Denis, both of France

[73] Assignee: Renault, Boulogne-Billancourt, France

[21] Appl. No.: 09/077,898

[22] PCT Filed: Oct. 18, 1996

[86] PCT No.: PCT/FR96/01632

§ 371 Date: Jun. 16, 1998

§ 102(e) Date: Jun. 16, 1998

[87] PCT Pub. No.: WO97/14877

PCT Pub. Date: Apr. 24, 1997

[30] Foreign Application Priority Data

Oct. 18, 1995 [FR] France ..... 95 12237

[51] Int. Cl.[7] ..... F01N 3/00

[52] U.S. Cl. ..... 60/285; 60/274; 60/276; 60/277; 123/691; 123/696

[58] Field of Search ..... 60/274, 276, 277, 60/285, 286; 123/691, 696

[56] References Cited

U.S. PATENT DOCUMENTS

| | | | |
|---|---|---|---|
| 3,939,654 | 2/1976 | Creps . | |
| 4,809,501 | 3/1989 | Kayanuma et al. . | |
| 4,831,838 | 5/1989 | Nagai et al. . | |
| 5,115,639 | 5/1992 | Gopp | 60/274 |
| 5,168,700 | 12/1992 | Furuya . | |
| 5,319,921 | 6/1994 | Gopp | 60/274 |
| 5,335,493 | 8/1994 | Uchida et al. | 60/274 |
| 5,363,647 | 11/1994 | Ohuchi et al. | 60/276 |
| 5,398,501 | 3/1995 | Ito et al. . | |
| 5,706,654 | 1/1998 | Nagai | 60/276 |

*Primary Examiner*—Thomas Denion
*Assistant Examiner*—Binh Tran
*Attorney, Agent, or Firm*—Oblon, Spivak, McClelland, Maier & Neustadt, P.C.

[57] ABSTRACT

A method and system for controlling fuel injected into an internal combustion engine fitted with a catalytic converter. A signal outputted by a first feedback loop and derived from the output of a first probe upstream from the catalytic converter is corrected in a corrector circuit by a value determined by another circuit on the basis of the output of a second probe downstream from the catalytic converter. The second circuit includes a comparator.

20 Claims, 4 Drawing Sheets

DUAL CONTROL LOOP SYSTEM AND METHOD FOR INTERNAL COMBUSTION ENGINES

BACKGROUND OF THE INVENTION

1. Field of the Invention

The invention relates to internal combustion engines of the fuel-injection type equipped with a catalytic exhaust converter and, more particularly in such engines, a system and a process for slaving the fuel-to-air ratio by a double feedback loop operating in real time.

2. Discussion of the Background

It is known how to use systems for modifying the quantity of fuel injected into an engine as a function of the exhaust-gas composition and, more particularly, of the oxygen content of these gases. To this end, the oxygen content is measured by means of a nonlinear sensor known as the "lambda" sensor or EGO sensor, where EGO is an English-language acronym for "Exhaust Gas Oxygen". Such a sensor is disposed upstream from the catalytic exhaust converter which treats the exhaust gases, and the signal delivered by this sensor is used to modify the quantity of fuel injected upstream from the engine cylinders via a first feedback loop.

In certain applications, it is known how to dispose a second lambda sensor downstream from the catalytic exhaust converter and to use the signal delivered by that sensor to measure, for example, the performances of the catalytic exhaust converter.

In other applications, the signal of this second sensor is used for slow regulation of the fuel-to-air ratio of the first loop by changing its operating point or by changing its transfer function. This slow regulation compensates for the aging of the first sensor on the basis of an average, but does not achieve real-time regulation of the fuel-to-air ratio, or in other words richness regulation, such that it is maintained at the stoichiometric value or close thereto, thus ensuring good operation of the catalytic converter and in turn less pollution.

SUMMARY OF THE INVENTION

One object of the present invention is therefore to provide, for internal combustion engines, a system and process with double control loop which permit real-time regulation of the fuel-to-air ratio.

Richness regulation is achieved, for example, by a fuel-injection calculator by virtue of the signal voltage delivered by the nonlinear sensor, to the effect that it modifies the injection time by means of a correction term. This correction term is a function of the sign of the difference between the sensor voltage and a threshold voltage. For example, when the sensor voltage is smaller than the threshold voltage, this means that the oxygen content is too high, and the correction comprises lengthening the fuel-injection time to increase the quantity of fuel, or in other words the richness. In the opposite case, the correction comprises shortening the fuel-injection duration to reduce the richness.

With such regulation, the physical characteristics of the sensor, such as the response time during lean-to-rich or rich-to-lean transitions and the dependence of the voltage characteristic as a function of richness according to the composition of the exhaust gases, may lead to a mean regulating richness different from the stoichiometric value.

In addition, to achieve maximum effectiveness of the catalytic exhaust converter or for any other aspect of tuning the engine, it may be necessary to choose a mean richness which is appreciably different from the stoichiometric value.

Another object of the present invention is therefore to provide, for internal combustion engines, a system and process with double control loop which permit modifying the mean richness and slaving it to a predetermined value. The invention therefore relates to a system with double loop for richness control for internal combustion engines of the fuel-injection type controlled by an electric computer and equipped with a catalytic converter which comprises:

- a first control loop comprising a first nonlinear sensor to deliver a first electrical signal $V_{upstream}$ representative of the proportion of one of the components of the engine exhaust gases at the inlet of the catalytic converter and a first correction circuit to process the said first electrical signal in such a way as to deliver to the computer a first signal KCL for correction of the quantity of fuel injected,
- a second control loop comprising a second nonlinear sensor to deliver a second electrical signal $V_{downstream}$ representative of the proportion of one of the components of the exhaust gases exiting the said catalytic converter, characterized in that it additionally comprises, in the second control loop, a second correction circuit to process the said second electrical signal $V_{downstream}$ in such a way as to deliver to the computer a second signal KRICH for correction of the quantity of fuel injected.

The second correction signal KRICH is added to the first correction signal KCL either at the instant of lean-to-rich and/or rich-to-lean transitions of the first correction signal KCL or in continuous manner.

The invention also relates to a process for controlling the quantity of fuel injected into an internal combustion engine of the fuel-injection type controlled by an electronic computer and equipped with a catalytic converter, the said electronic computer receiving a first correction signal KCL from a first feedback loop comprising a first nonlinear sensor, the process being characterized by the following steps:

(a) measurement, at the outlet of the catalytic converter, by means of a second nonlinear sensor, of the proportion of one of the components of the outlet gases of the said catalytic converter in such a way as to obtain an electrical signal $V_{downstream}$ whose amplitude is representative of the said proportion, (b) construction, starting from the said electrical signal $V_{downstream}$, of a second correction signal KRICH, and (c) modification of the first correction signal KCL by the said second correction signal KRICH.

BRIEF DESCRIPTION OF THE DRAWINGS

Other characteristics and advantages of the present invention will become apparent upon reading the following description of particular embodiments, the said description being made with reference to the attached drawings, wherein.

DETAILED DESCRIPTION OF THE PREFERRED EMBODIMENTS

Figure 1:
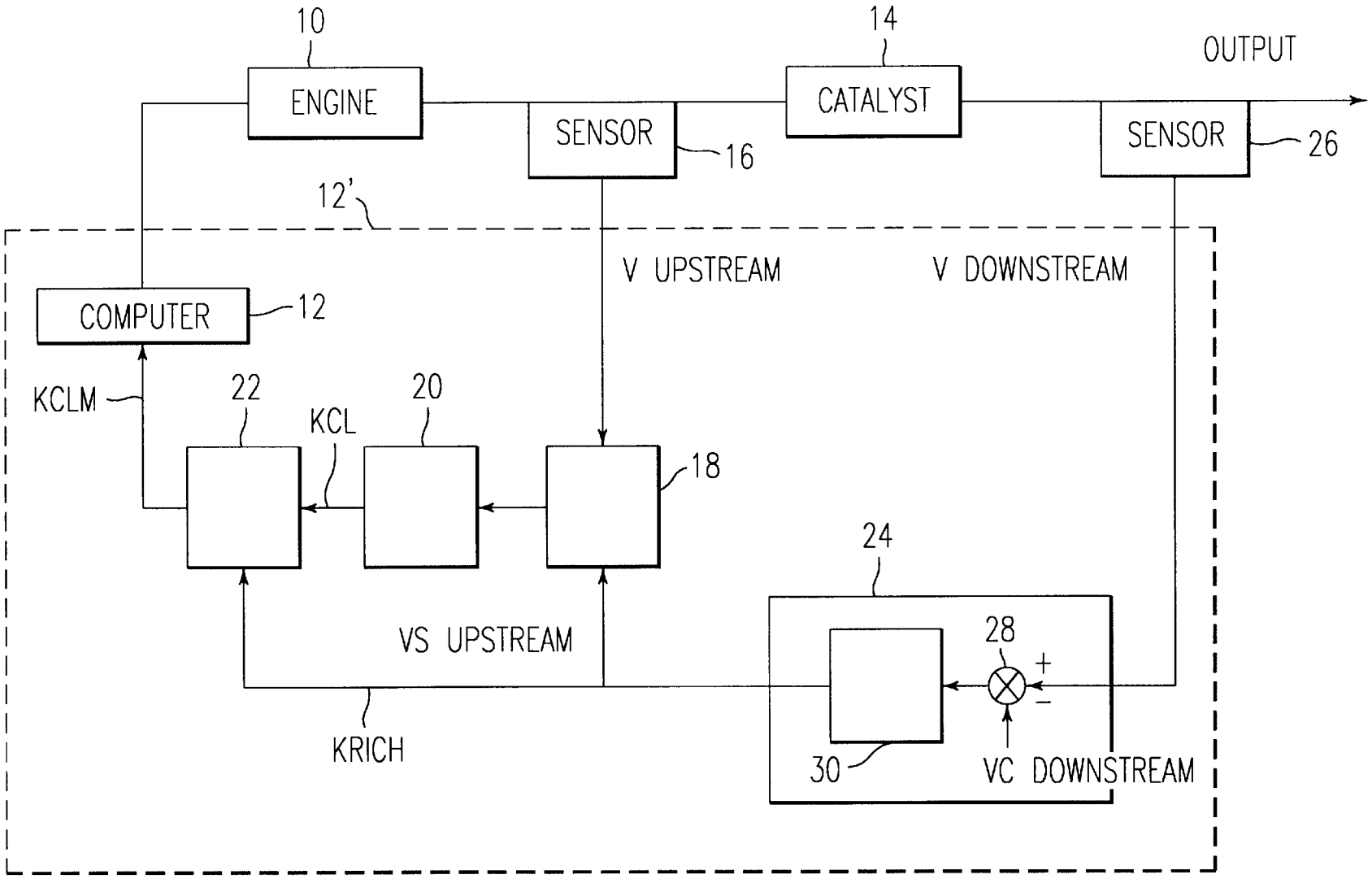
FIG. 1 is a functional diagram of a first double richness loop according to the invention, FIGS. 2-A and 2-B are diagrams showing a strategy for richness correction according to the prior art with a single feedback loop, FIGS. 3-A to 3-J are diagrams showing different modes or strategies according to the invention for correcting the richness, FIGS. 4-A, 4-B and 4-C are diagrams showing another mode according to the invention for correcting the richness.
Figure 2A:
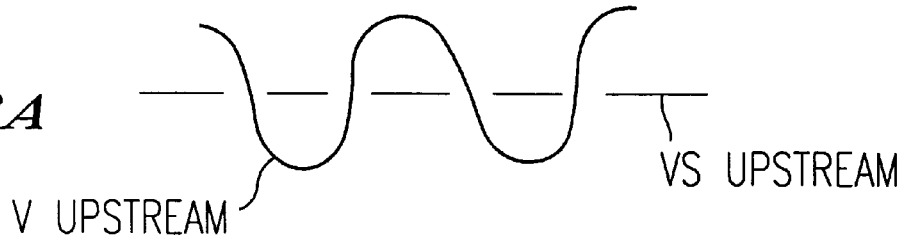
Figure 2B:
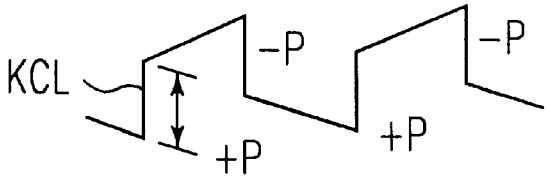

In FIG. 1, an internal combustion engine 10 is controlled in known manner by an electronic computer 12. The exhaust gases of this engine are filtered by an exhaust muffler 14 of the catalytic converter type, from which they escape to the open air. A first sensor 16 is disposed at the inlet of the exhaust muffler and measures the content of one of the main components of the exhaust gases, this component usually being oxygen. This sensor is of the nonlinear type, and is often called, as indicated hereinabove, a "lambda" sensor or EGO sensor. This sensor delivers at its output terminal an electric signal $V_{upstream}$ (FIG. 2-A), which is applied to a comparator circuit 18 in which $V_{upstream}$ is compared with a threshold voltage $VS_{upstream}$ to determine the sign of $V_{upstream}$ relative to that threshold.

The threshold value $VS_{upstream}$ depends on the sensor characteristics and corresponds to the transition voltage of the sensor when the conditions of stoichiometry are satisfied.

The output terminal of comparator circuit 18, which delivers a binary signal 1 or 0, is connected to the input terminal of a first richness-regulating correction circuit 20 of the proportional-plus-integral type with gains P and I respectively. The correction circuit 20 delivers a signal KCL, which has the shape represented by the diagram of FIG. 2-B. It is this signal KCL which is delivered to computer 12 to control the quantity of fuel to be injected. Thus, as soon as $V_{upstream}$ becomes smaller than $VS_{upstream}$, this means that the mixture is lean in fuel and that the quantity of fuel must be increased. This is accomplished by the jump +P (FIG. 2-B) followed by a positive slope of value I until the instant that $V_{upstream}$ exceeds $VS_{upstream}$, which means that the mixture has become rich in fuel and that the quantity thereof must be reduced. This is accomplished by a jump −P followed by a negative slope of value I.

According to the invention, the correction value KCL delivered by correction circuit 20 is modified by a second correction circuit 22, which introduces a correction term KRICH before being applied to computer 12. This correction term KRICH is determined by a circuit 24 on the basis of an output signal $V_{downstream}$ of a second lambda sensor 26, which is disposed at the outlet of the catalytic exhaust converter 14. This circuit 24 substantially comprises a comparator 28, to which there are applied the signal $V_{downstream}$ and a setpoint signal denoted by $VC_{downstream}$, and a third correction circuit 30, to which there is applied the signal ($V_{downstream}-VC_{downstream}$) delivered by comparator circuit 28. The third correction circuit 30 is, for example, of the proportional plus integral type, and delivers the signal KRICH, which is applied to the second correction circuit 22.

The second correction circuit 22 is able to introduce the correction KRICH by different modes or strategies, which will be explained with reference to the timing diagrams of FIGS. 3-A to 3-J. The diagrams of FIGS. 3-A to 3-J are plots of the signal KCL as modified by the second correction circuit 22 in different modes, the modified signal KCL being denoted by $KCL_m$.

According to a first mode (FIGS. 3-A and 3-B), the signal KRICH is applied during lean-to-rich transitions detected by the first sensor, which corresponds to the descending side of the signal KCL. In the case in which KRICH>0 (increasing the richness), the plot of $KCL_m$ is that of FIG. 3-A, while in the case in which KRICH<0 (increasing the leanness), the plot of $KCL_m$ is that of FIG. 3-C.

According to a second mode (FIGS. 3-C and 3-D), the signal KRICH is applied during rich-to-lean transitions detected by the first sensor, which corresponds to the ascending side of the signal KCL. In the case in which KRICH>0 (increasing the richness), the plot of $KCL_m$ is that of FIG. 3-C, while in the case in which KRICH<0 (increasing the leanness), the plot of $KCL_m$ is that of FIG. 3-D.

According to a third mode (FIGS. 3-E and 3-F), the signal KRICH is applied during each transition, but with half the value of KRICH, or in other words KRICH/2. In the case in which KRICH>0 (increasing the richness), the plot of $KCL_m$ is that of FIG. 3-E, while in the case in which KRICH<0 (increasing the leanness), the plot of $KCL_m$ is that of FIG. 3-F.

According to a fourth mode (FIGS. 3-G, 3-H), KRICH is applied during lean-to-rich transitions (descending side) when it is positive (increasing the richness), according to the plot of FIG. 3-G, and during rich-to-lean transitions (ascending side) when it is negative (increasing the leanness), according to the plot of FIG. 3-H.

According to a fifth mode (FIGS. 3-I and 3-J), KRICH is applied during rich-to-lean transitions (ascending side) when it is positive (increasing the richness), according to the plot of FIG. 3-I, and during lean-to-rich transitions (descending side) when it is negative (increasing the leanness), according to the plot of FIG. 3-J.

According to a sixth mode (FIGS. 4-A to 4-C), the signal KRICH is added to KCL in such a way as to modify the slope of the integral for obtaining $KCL_m$ such that:

$$KCL_m=KCL+KRICH$$

at the end of the regulation period, which implies that the slope must be modified by the value KRICH/T, where T is a fixed value which is on the order of the regulation period. Consequently, the slope α of FIGS. 4-B and 4-C is given by:

$$\alpha=I+KRICH/T,$$

while the slope Θ is given by:

$$\Theta=-I+KRICH/T.$$

Figure 4A:
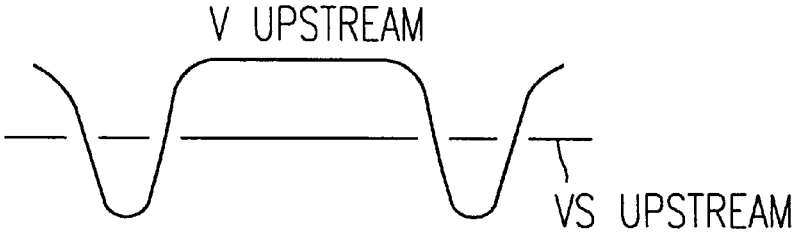
Figure 4B:
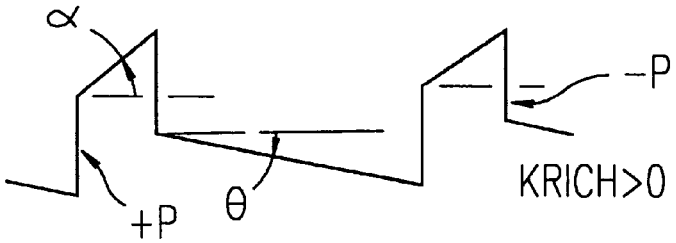
Figure 4C:
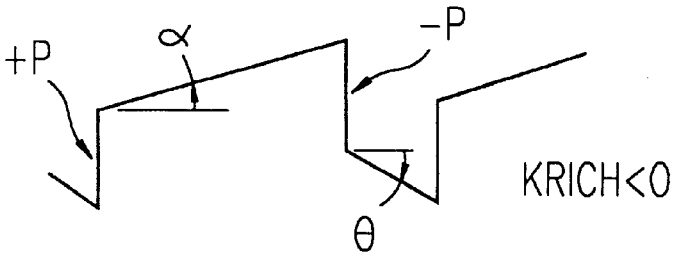
Figure 3A:
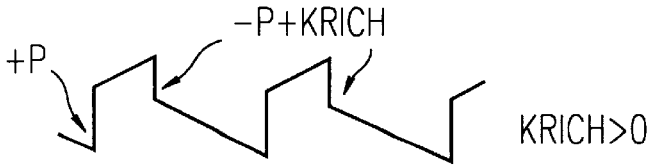
Figure 3B:
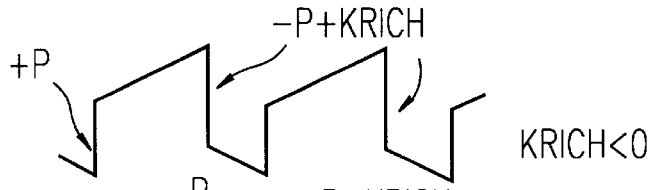
Figure 3C:
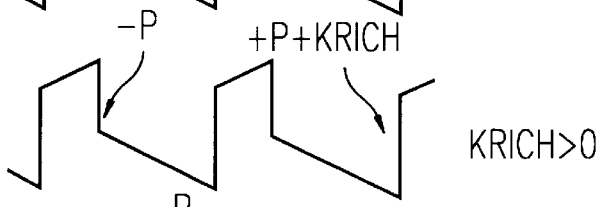
Figure 3D:
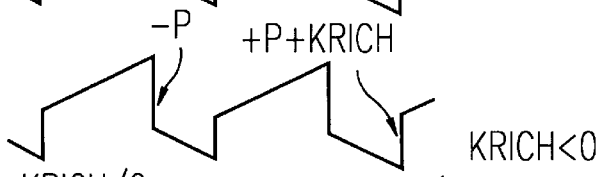
Figure 3E:
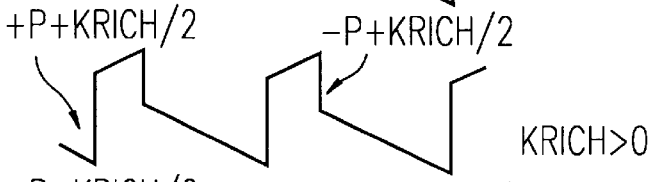
Figure 3F:
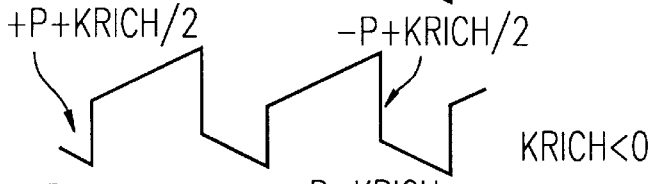
Figure 3G:
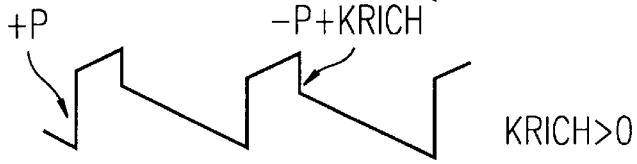
Figure 3H:
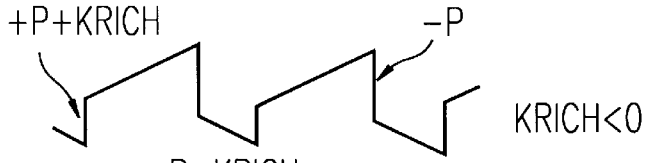
Figure 3I:
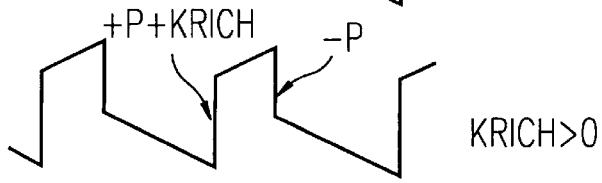
Figure 3J:
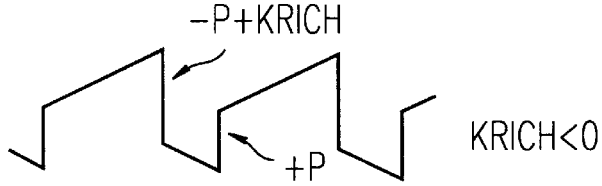

The plot of FIG. 4-B is then obtained for KRICH>0 (increasing the richness) and that of FIG. 4-C for KRICH<0 (increasing the leanness).

FIG. 4-A represents, in correspondence with FIG. 4-B, the variation of the voltage $V_{upstream}$ relative to $VS_{upstream}$ and defines the lean-to-rich and rich-to-lean transitions.

In the description of FIG. 1, for reasons of clarity of the explanation, the circuits 18, 20, 22, 28 and 30 were separated from each other to show the characteristics of the invention more clearly. In reality, these circuits are integral parts of computer 12, which encompasses all the circuits inside the rectangle outlined by broken line 12'.

The system of FIG. 1 can present variants, which will be described with reference to FIG. 5.

Figure 5:
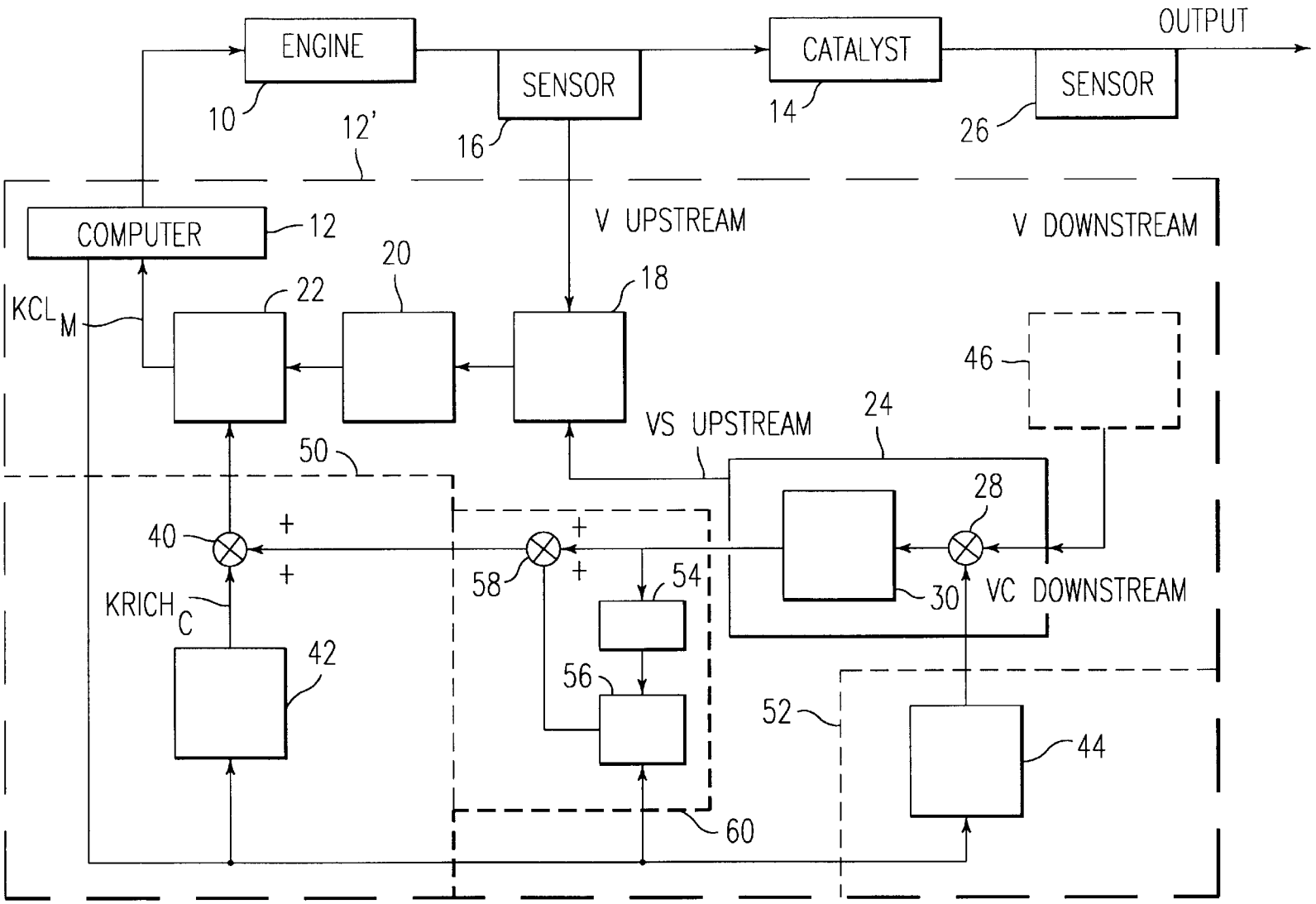
FIG. 5 is a functional diagram of several variants according to the invention.

Thus, in the variant according to the rectangle outlined by dotted line 50 in FIG. 5, the output signal KRICH of correction circuit 24 is applied to correction circuit 22 via an adder circuit 40. This adder circuit 40 comprises a first input terminal to which there is applied the signal KRICH, and a second input terminal to which there is applied a signal or communication $KRICH_C$ delivered by a map or memory 42 as a function of the operating point of the engine. This map 42 is addressed by the characteristics of the operating point of the engine, such as the engine speed and the manifold pressure, which are delivered by the computer 12. It is the signal resulting from the addition KRICH+$KRICH_C$= $KRICH_\Sigma$ that is applied to the correction circuit 22 and used according to the modes described hereinabove.

To this first variant relating to modification of the value of KRICH there can be added, either in combination or separately, a variant according to the rectangle outlined by dotted line 52 and relating to the variation of the setpoint voltage $VC_{downstream}$ according to a map for a certain number of operating points. These values of $VC_{downstream}$ for different operating points are stored in a map 44 which, is addressed by computer 12.

In another variant, the signal $V_{downstream}$ is filtered through a low-pass filter 46 before being applied to correction circuit 24. Such filtering permits elimination of the frequencies corresponding to beating states of the richness regulation that were not completely damped by the catalytic converter.

In another variant according to rectangle 60 of FIG. 5, the signal KRICH is filtered in a first-order filter 54 to obtain a signal $KRICH_{mean}$, the value of which is stored in a memory 56. During reading of the memory 56, the read signal is applied to an adder circuit 58, which also receives the signal KRICH. The signal is applied to the correction circuit 22 either via adder circuit 40 or directly in the absence of adder circuit 40.

Instead of a single value of $KRICH_{mean}$, memory 56 can contain a plurality of values, each corresponding to an operating point of the engine defined by an engine speed and a manifold pressure. Memory 56 is addressed by computer 12 in just the same way as memories 42 and 44. At the output of adder circuit 58, the value of the signal $KRICH_f$ is given by:

$$KRICH_f=KRICH_{mean}+KRICH=KRICH_{mean}+KRICH_{prop}+KRICH_{int},$$

where $KRICH_{prop}$ and $KRICH_{int}$ respectively denote the "proportional" and "integral" terms of the signal KRICH. As it happens, the proportional term has zero mean value, and so $KRICH_{mean}$ is a filtered value of $KRICH_{int}$.

What is claimed is:

1. A system with double loop for richness control for internal combustion engines of the fuel-injection type controlled by an electronic computer and equipped with a catalytic converter which comprises:

a first control loop comprising a first nonlinear sensor to deliver a first electrical signal representative of the proportion of one of the components of the exhaust gases of the engine at the inlet of the catalytic converter and a first correction circuit to process the said first electrical signal in such a way as to deliver to the computer a first signal for correction of the quantity of fuel injected, a second control loop comprising a second nonlinear sensor to deliver a second electrical signal representative of the proportion of one of the components of the exhaust gases exiting the said catalytic converter, and a second correction circuit to process the said second electrical signal in such a way as to deliver to the computer a second signal for correction of the quantity of fuel injected, characterized in that it additionally comprises, in the second control loop, a circuit for filtering the output signal of the second correction circuit and an adder circuit, to which there are applied the output signal of the second correction circuit and the output signal of the filter circuit.

2. A system according to claim 1, characterized:

in that the circuit for filtering the output signal of the second correction circuit delivers a mean signal, and in that at least one value of the said mean signal is stored in a memory, such that it is read under the control of computer to be applied to the adder circuit.

3. A system according to claim 2, characterized in that the first control loop additionally comprises a third correction circuit, to which there are applied the first correction signal and the said second correction signal and which delivers to the computer a third signal for correction of the quantity of fuel injected.

4. A system according to claim 1, characterized in that the first control loop additionally comprises a third correction circuit, to which there are applied the first correction signal and the said second correction signal and which delivers to the computer a third signal for correction of the quantity of fuel injected.

5. A system according to claim 4, characterized in that the said third correction circuit is an adder circuit.

6. A system according to claim 1, characterized in that the second correction circuit comprises:

a comparator circuit for comparing the amplitude of the said second electrical signal with a setpoint value so as to deliver a signal representative of the difference thereof, and a circuit for processing the difference signal to deliver the said second correction signal so as to slave the second electrical signal to the setpoint value.

7. A system according to claim 6, characterized in that the processing circuit applies to the difference signal a transfer function of the proportional plus integral type.

8. A system according to claim 6, characterized in that it additionally comprises a second memory for storing a plurality of values of the setpoint voltage, each value corresponding to an operating point of the engine, reading from the said memory being under the control of computer such that the read value corresponds to the operating point of the said engine.

9. A system according to claim 8, characterized in that the third memory is provided for storing a plurality of values of the mean signal, each value corresponding to an operating point of the engine and being selected during reading by computer as a function of the characteristics of the operating point of the engine.

10. A system according to claim 1, characterized in that it additionally comprises a fourth correction circuit for modifying the said second correction signal by a value corresponding to a value of the second correction signal for at least one operating point of the engine.

11. A system according to claim 10, characterized in that the fourth correction circuit comprises a first memory in which there is stored at least one value corresponding to a value of the second correction signal for one operating point of the engine and an adder circuit for adding the value read from the said memory to the second correction signal, reading from the said memory being under the control of computer such that the read value corresponds to the operating point of the said engine.

12. A system according to claim 1, characterized in that it additionally comprises a low-pass filter, to which there is applied the output signal of the second sensor and which delivers a filtered signal to the input of the second correction circuit.

13. A process for controlling the quantity of fuel injected into an internal combustion engine of the fuel-injection type controlled by an electronic computer and equipped with a catalytic converter, the said electronic computer receiving a first signal for correction of the quantity of fuel injected from a first feedback loop comprising a first nonlinear sensor (16), to deliver a first electrical signal representative of the proportion of one of the components of the exhaust gases of the engine at the inlet of the catalytic converter, and receiving a second signal for correction of the quantity of fuel injected from a second feedback loop comprising a second nonlinear sensor, to deliver a second electrical signal representative of the proportion of one of the components of the exhaust gases exiting the said catalytic converter, the process being characterized by the following steps:

(a) filtering of the second correction signal, (b) storage in memory of at least one value of the filtered signal, (c) selection by the computer of a value stored in memory, (d) addition of the value selected from the memory to the second correction signal to obtain a modified second correction signal, (e) modification of the first correction signal by the second correction signal modified according to steps (a), (b), (c) and (d).

14. A process according to claim 13, characterized in that step (e) comprises:

applying the modified second correction signal during lean-to-rich transitions of the first correction signal.

15. A process according to claim 13, characterized in that step (e) comprises:

applying the modified second correction signal during rich-to-lean transitions of the first correction signal.

16. A process according to claim 13, characterized in that step (e) comprises:

applying half of the value of the modified second correction signal during each lean-to-rich and rich-to-lean transition of the first correction signal.

17. A process according to claim 13, characterized in that step (e) comprises:

applying the modified second correction signal during lean-to-rich transitions of the first correction signal when the said modified second correction signal is positive and during rich-to-lean transitions of the first correction signal when the said modified second correction signal is negative.

18. A process according to claim 13, characterized in that step (e) comprises:

applying the modified second correction signal during rich-to-lean transitions of the first correction signal when the said modified second correction signal is positive and during lean-to-rich transitions of the first correction signal when the said modified second correction signal is negative.

19. A process according to claim 13, characterized in that step (e) comprises:

applying the modified second correction signal in the form of a continuous variation of the first correction signal for a determined duration.

20. A process according to claim 19, characterized in that the said continuous variation of the first correction signal comprises modifying the slope of the integral by a modified value of KRICH that is inversely proportional to the duration throughout the said determined duration.

* * * * *